US009764328B2

(12) United States Patent
Sun et al.

(10) Patent No.: US 9,764,328 B2
(45) Date of Patent: Sep. 19, 2017

(54) FLEXIBLE VERTICAL GRINDER

(71) Applicant: HUNAN ZHONGHONG HEAVY MACHINERY CO., LTD, Shaoshan, Hunan (CN)

(72) Inventors: Zishun Sun, Hunan (CN); Hongzhong Sun, Hunan (CN)

(73) Assignee: HUNAN ZHONGHONG HEAVY MACHINERY CO., LTD, Shaoshan, Hunan (CN)

( * ) Notice: Subject to any disclaimer, the term of this patent is extended or adjusted under 35 U.S.C. 154(b) by 401 days.

(21) Appl. No.: 14/421,988

(22) PCT Filed: Aug. 16, 2013

(86) PCT No.: PCT/CN2013/081674

§ 371 (c)(1),
(2) Date: Feb. 16, 2015

(87) PCT Pub. No.: WO2014/026649

PCT Pub. Date: Feb. 20, 2014

(65) Prior Publication Data

US 2015/0217298 A1 Aug. 6, 2015

(30) Foreign Application Priority Data

Aug. 17, 2012 (CN) ..... 2012 1 0293481

(51) Int. Cl.
*B02C 15/00* (2006.01)
*B02C 15/08* (2006.01)

(52) U.S. Cl.
CPC ..... *B02C 15/08* (2013.01); *B02C 15/004* (2013.01)

(58) Field of Classification Search
CPC ..... B02C 15/004; B02C 15/08
USPC ..... 241/129, 131
See application file for complete search history.

(56) References Cited

U.S. PATENT DOCUMENTS 960,893 A * 6/1910 Gore ..... B02C 15/12 241/118
1,319,735 A * 10/1919 Thuneman ..... B02C 15/08 241/115
1,349,235 A * 8/1920 Stout ..... B02C 15/02 241/129
1,356,292 A * 10/1920 Kennedy ..... B02C 15/02 241/129
1,573,191 A * 2/1926 Raymond ..... B02C 15/02 241/109
1,706,254 A * 3/1929 Rees ..... B02C 15/02 126/39 C (Continued)

*Primary Examiner* — Faye Francis

(57) ABSTRACT

A flexible vertical grinder, having a main shaft mounting frame (4) on a grinder frame (1); a main shaft (3) is mounted on the main shaft mounting frame; a stelliform bracket (9) is mounted on the main shaft; a hammer wheel grinder and a material-sorting balance wheel device are mounted on the stelliform bracket; the material-sorting balance wheel (4) and the hammer wheel (17) are on the same horizontal plane. The vertical grinder can apply different grinding forces according to different specific surface areas of the to-be-ground material, and can grind materials of different grades properly but not excessively, thus greatly improving crushing efficiency, having good overall rigidity and stable operation, and facilitating maintenance.

10 Claims, 5 Drawing Sheets

(56) References Cited

U.S. PATENT DOCUMENTS

| | | | | | |
|---|---|---|---|---|---|
| 1,778,525 | A * | 10/1930 | Frisch | F16N 7/40 | 184/6.18 |
| 1,782,867 | A * | 11/1930 | Davidson | F16N 7/38 | 184/6 |
| 1,898,823 | A * | 2/1933 | Forbes | B02C 15/02 | 241/129 |
| 1,936,593 | A * | 11/1933 | Fraser | B02C 15/02 | 241/109 |
| 1,975,514 | A * | 10/1934 | Leach | B02C 15/08 | 241/173 |
| 2,177,945 | A * | 10/1939 | Piper | B01F 9/20 | 241/118 |
| 2,200,825 | A * | 5/1940 | Hund | B02C 15/02 | 241/124 |
| 2,413,793 | A * | 1/1947 | Sharp | B02C 15/08 | 241/124 |
| 3,027,103 | A * | 3/1962 | Mischanski | B02C 15/00 | 241/131 |
| 3,910,509 | A * | 10/1975 | Eirich | B02C 15/02 | 241/120 |
| 4,063,687 | A * | 12/1977 | Szego | B02C 15/02 | 241/110 |
| 4,830,290 | A * | 5/1989 | Williams | B02C 15/02 | 241/109 |
| 2010/0282883 | A1 * | 11/2010 | Dixon | B02C 15/02 | 241/109 |

* cited by examiner

FLEXIBLE VERTICAL GRINDER

CROSS REFERENCE OF RELATED APPLICATION

This is a U.S. National Stage under 35 U.S.C 371 of the International Application PCT/CN2013/081674, filed Aug. 16, 2013, which claims priority under 35 U.S.C. 119(a-d) to CN 201210293481.0, filed Aug. 17, 2012.

BACKGROUND OF THE PRESENT INVENTION

Field of Invention

The present invention relates to a grinding machine.

Description of Related Arts

The grinders reported by the Chinese patent literatures include a wide variety of items, from vertical multilayer combined floating grinders, stacked planetary vertical grinders, pendulum roller grinders to loop grinders.

The basic principle is as follows. The rotation of the center shaft drives the grinding wheel on every layer to revolve not only publicly but on its own axis, the grinding wheel grinds the falling materials on the loop wall relying on the inertial centrifugal force, the falling materials layer by layer pass through the even material plate and are pushed to the barrel wall, and then fall into a next layer grinding ring layer by layer. The grinding wheel on every layer depends on the driving of the center shaft to work on the materials at a basically constant same grinding pressure, so that the materials on an upper layer with large specific surface area grind excessively the fine materials falling layer by layer to produce the over grinding, the next layer only can grind the rough particles falling from the upper layer to a fineness capable of being ground, the lower layers of the multilayer combination only can reshape the materials. In general, in the conventional broken grinding ore, the energy consumption of the broken crushing ore is low, that of the grinding ore is high, according to the statistics, the energy consumption of the broken crushing ore is only 12%-15% that of the grinding ore. The efficiency of the broken ore is higher than that of the grinding ore, which meets the principle that the power consumed by the grinding ore is in direct proportion to the newly generated surface area in the grinding products.

Improving the rotational speed and increasing the centrifugal force will aggravate the over crushing on the upper layers, which is not capable of grinding the materials by grading. The above multilayer loop grinders is not capable of playing a role in "more crushing and less grinding", thereby having larger shortcomings as follows. The structure of the machine is unstable while being operated under variable loading, the service life is short, the efficiency is lower, no work increases the energy consumption, and the wear-resistant parts consume greatly.

SUMMARY OF THE PRESENT INVENTION

An object of the present invention is to provide an environmentally flexible multilayer vertical grinder with high operation efficiency, reasonable structure, low energy consumption, convenience for replacing the easily-damaged parts and good sealing performance, aiming at the shortcomings of the existing multilayer ring grinders comprising floating grinders, planetary vertical grinders and pendulum roller grinders.

A technical solution of the present invention is to provide a flexible vertical grinder, wherein a casing is fixed on a grinder frame, a main shaft mounting frame is located on the grinder frame, a main shaft is mounted on the main shaft mounting frame, a large pulley is mounted to a lower end of the main shaft, a spoke of the large pulley is downwardly spiral; a material unloading bucket is mounted to a lower end of the casing within the grinder frame, a material receiving bucket is located at an upper side face of an outer edge of an inner ring of the large pulley, the material receiving bucket is sleevedly mounted on an outer side face of a lower end of the material unloading bucket; an arched material feeding bucket is mounted on an upper end of the casing; a stelliform bracket is mounted on the main shaft within the casing, an upper end of the stelliform bracket is fixed on the main shaft by a pressure plate, a hammer wheel grinding device and a material-sorting balance wheel device are mounted on the stelliform bracket; the hammer wheel grinding device comprises a swing arm, the swing arm is mounted on the stelliform bracket by a swing arm shaft, a balance hammer is mounted to one end of the swing arm, a hammer wheel shaft is mounted to the other end of the swing arm, a hammer wheel is mounted on the hammer wheel shaft, a grind ring is mounted to an inner wall of the casing corresponding to the hammer wheel, a reducing flow ring is mounted below the grind ring; the material-sorting balance wheel device comprises a material-sorting balance wheel, the material-sorting balance wheel and the hammer wheel are on a same horizontal plane, the material-sorting balance wheel is mounted to one end of a swing rod by a material-sorting balance wheel shaft, the other end of the swing rod is mounted on the stelliform bracket by a swing rod shaft.

A cross section of the arched material feeding bucket is trapezoidal, the arched material feeding bucket is mounted on an inner wall of a circular ring pressure plate, and the circular ring pressure plate is fixed to the upper end of the casing.

At least two layers of hammer wheel grinding devices and material-sorting balance wheel devices are mounted on the stelliform bracket.

A material scraping plate is mounted to a lower end of the hammer wheel shaft.

The swing arm shaft is mounted on the stelliform bracket by a swing arm bearing, two bearing dustproof caps are respectively mounted at an upper side and a lower side of the swing arm bearing, the swing arm is mounted on the swing arm shaft by a locking screw.

A hammer wheel seat is mounted on the hammer wheel shaft, the hammer wheel seat is mounted on the hammer wheel shaft by a hammer wheel seat locking screw, a hammer wheel bearing is mounted between the hammer wheel shaft and the hammer wheel seat, two hammer wheel bearing dustproof caps are respectively mounted at an upper end and a lower end of the hammer wheel bearing, a ring gasket is mounted on the hammer wheel shaft between the hammer wheel bearing and the swing arm, the hammer wheel is mounted on the hammer wheel seat by a hammer wheel pressure ring.

A material-sorting balance wheel seat is mounted on the material-sorting balance wheel shaft, a balance wheel seat bearing is mounted between the material-sorting balance wheel shaft and the material-sorting balance wheel seat, two balance wheel seat bearing dustproof caps are respectively mounted at an upper end and a lower end of the material-sorting balance wheel seat, the material-sorting balance wheel is mounted on the material-sorting balance wheel seat.

A material-sorting balance wheel shaft sliding sleeve is mounted between the two balance wheel seat bearing dustproof caps and the material-sorting balance wheel shaft, a sealing ring is mounted between a contacting surface of the material-sorting balance wheel shaft sliding sleeve and a contacting surface of the material-sorting balance wheel shaft, a sliding sleeve is mounted between a contacting surface of the swing rod and a contacting surface of the swing rod shaft.

The material-sorting balance wheel is made of rubber.

A plurality of material screening holes are provided on a horizontal ring surface of the reducing flow ring.

The present invention has technical effects as follows: (1) under the setting speed, from above down, for the grinding body on different layers, different grinding forces are applied according to different specific surface areas of ground materials, which accords with the principle of "more crushing and less grinding" and is capable of grinding materials with different levels, the materials are not over-ground; (2) the material bed is stable, which avoids the phenomenon of "steel sharpening steel" and reduces the grinding consumption; (3) the present invention is capable of not only dry grinding, but wet grinding, so that the applied range of the multilayer loop grinder is widened, the material falling of the barrel is free, and the phenomenon of "bulging belly" is resolved; (4) the efficiency of crushing is greatly improved, compared with the existing loop grinders, the present invention greatly reduces the electricity consumption; (5) the present invention has good rigidity of whole machine, stable operation, no dust pollution and low noise; and (6) the present invention is convenient and easy to be maintained.

DETAILED DESCRIPTION OF THE PREFERRED EMBODIMENT

Examples

Figure 1:
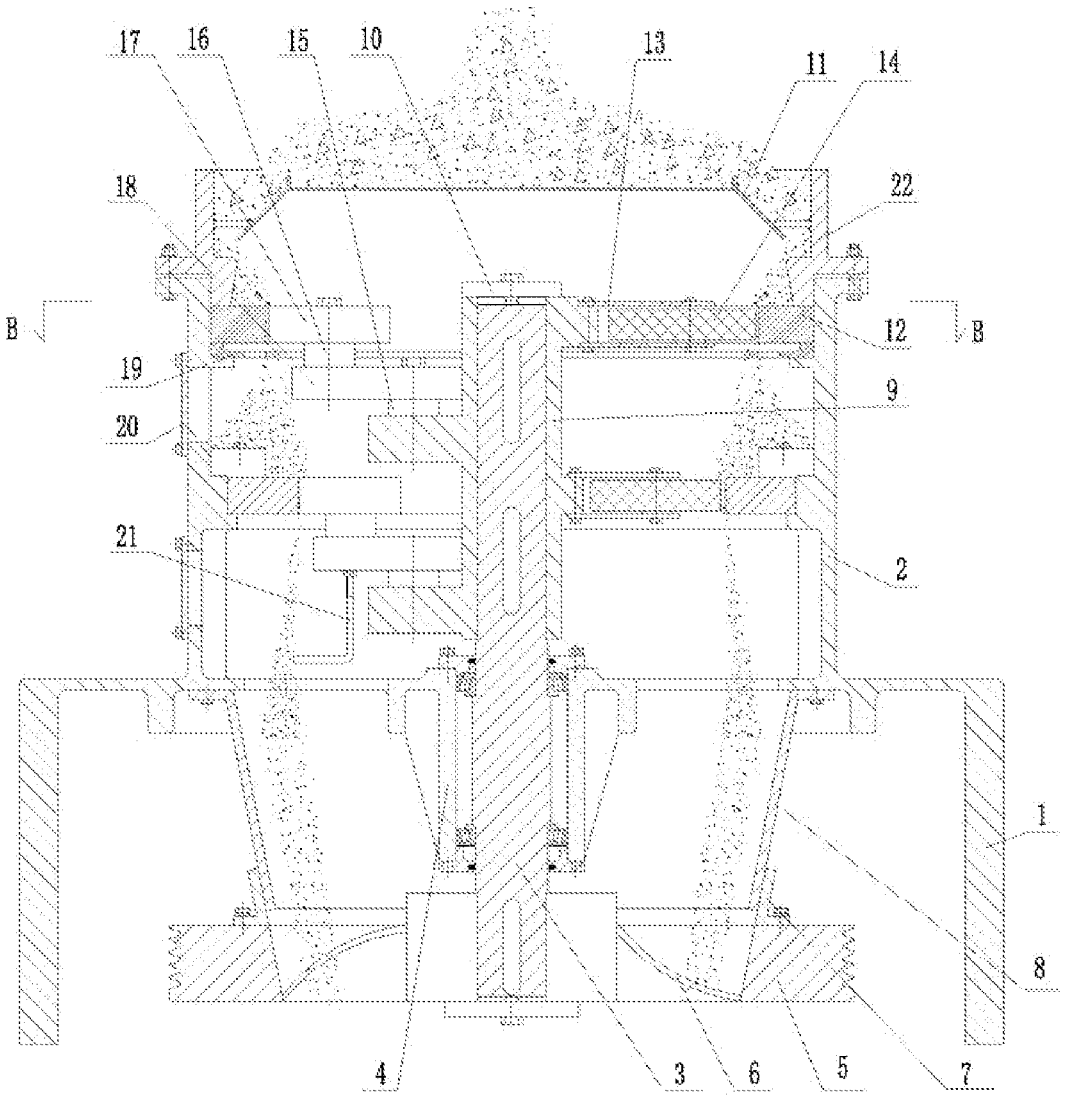
FIG. 1 is a sectional view along A-A of the present invention.
Figure 2:
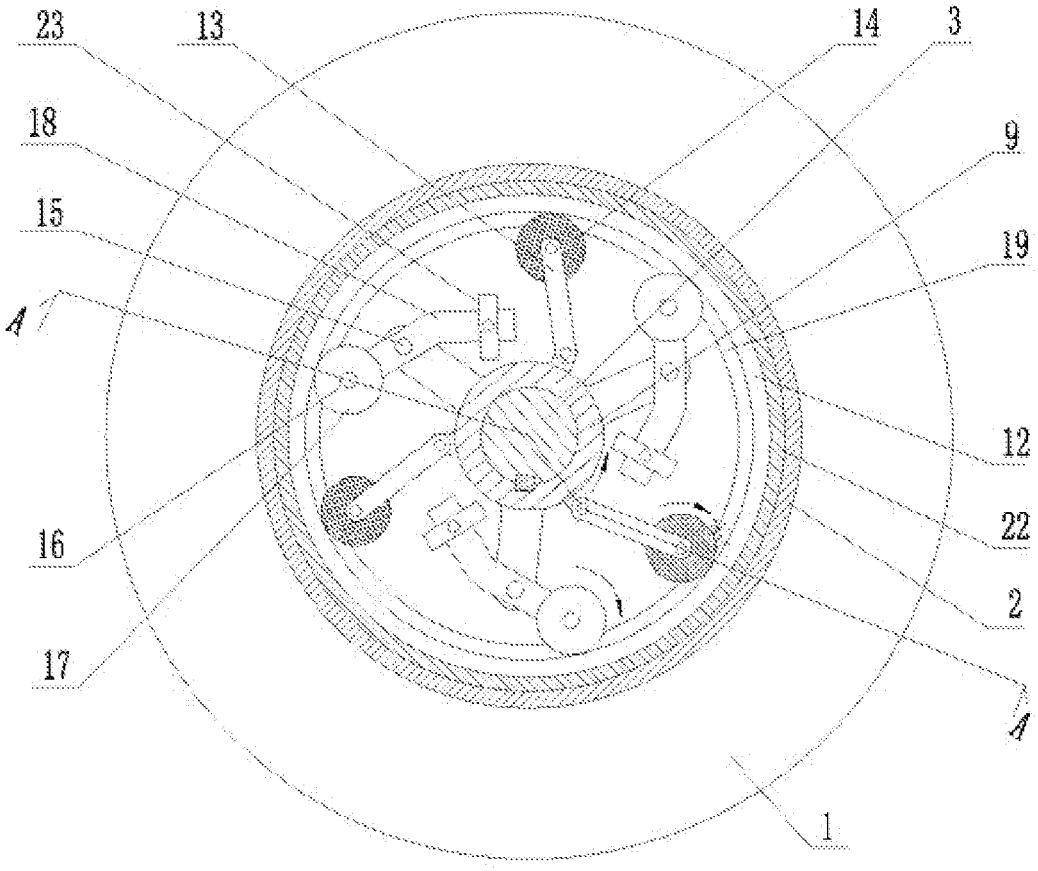
FIG. 2 is a sectional view along B-B of the present invention.
Figure 3:
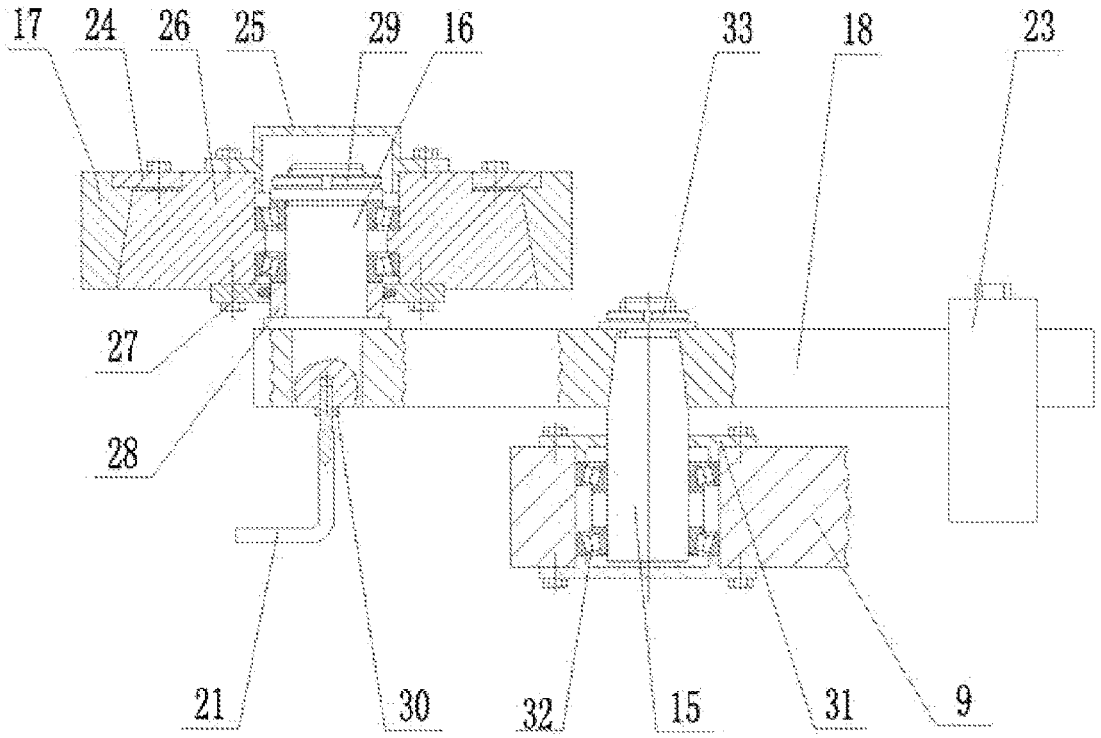
FIG. 3 is a structurally schematic view of a hammer wheel grinding device of the present invention.
Figure 4:
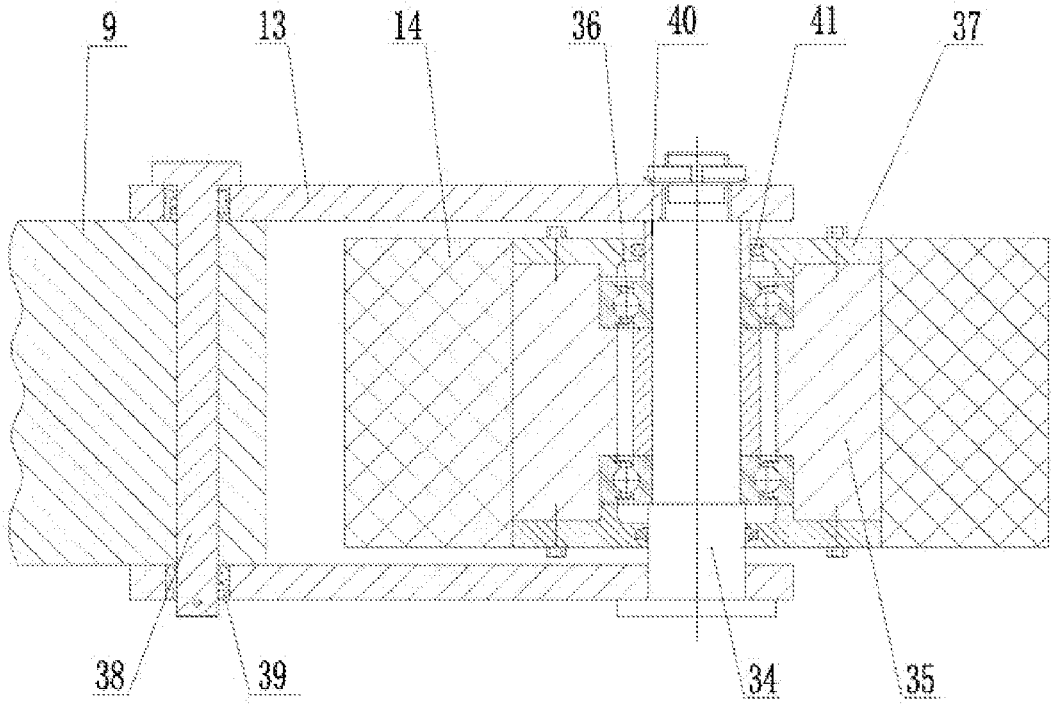
FIG. 4 is a structurally schematic view of a material-sorting balance wheel device of the present invention.
Figure 5:
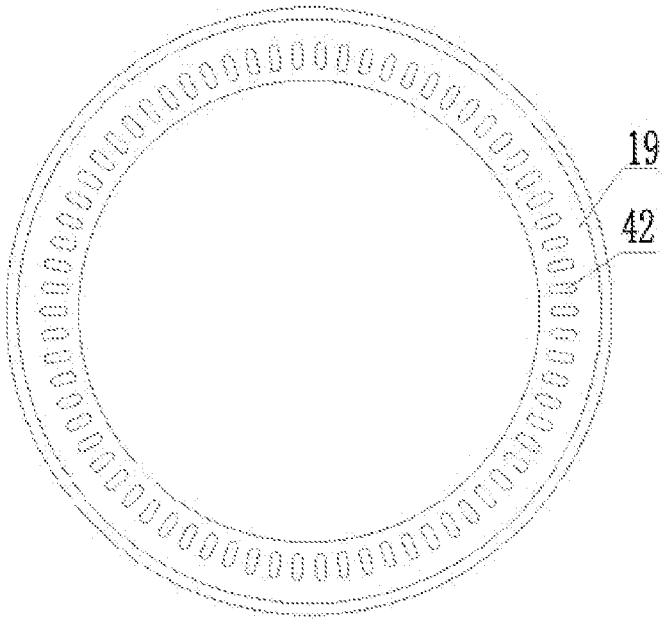
FIG. 5 is a top view of a reducing flow ring of the present invention.
Figure 6:
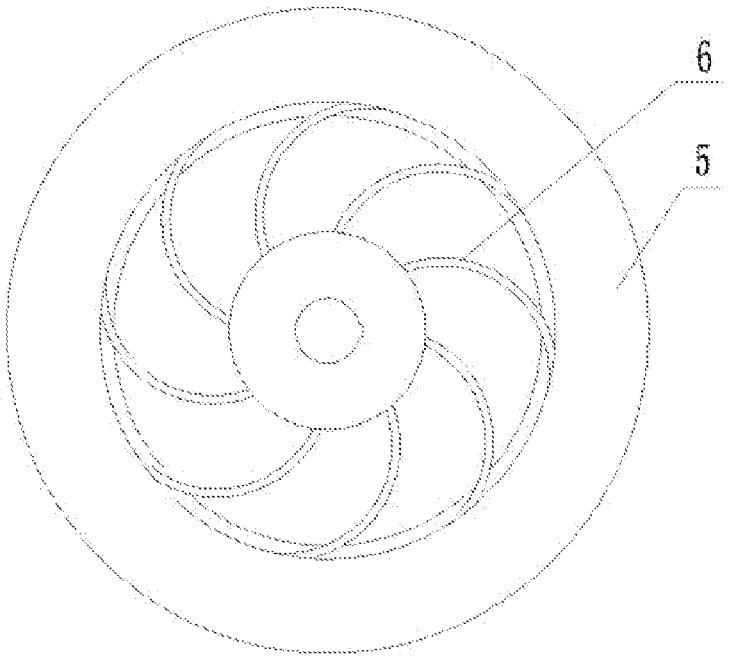
FIG. 6 is a top view of a large pulley of the present invention.

As shown in FIGS. 1-6, a flexible vertical grinder is illustrated. A casing 2 is fixed on a grinder frame 1, a main shaft mounting frame 4 is located on the grinder frame 1, a main shaft 3 is mounted on the main shaft mounting frame 4, a large pulley 5 is mounted to a lower end of the main shaft 3, a spoke 6 of the large pulley 5 is downwardly spiral; a material unloading bucket 8 is mounted to a lower end of the casing 2 within the grinder frame 1, a material receiving bucket 7 is located at an upper side face of an outer edge of an inner ring of the large pulley 5, the material receiving bucket 7 is sleevedly mounted on an outer side face of a lower end of the material unloading bucket 8; an arched material feeding bucket 11 is mounted on an upper end of the casing 2; a stelliform bracket 9 is mounted on the main shaft 3 within the casing 2, an upper end of the stelliform bracket 9 is fixed on the main shaft 3 by a pressure plate 10, a hammer wheel grinding device and a material-sorting balance wheel device are mounted on the stelliform bracket 9; the hammer wheel grinding device comprises a swing arm 18, the swing arm 18 is mounted on the stelliform bracket 9 by a swing arm shaft 15, a balance hammer 23 is mounted to one end of the swing arm 18, a hammer wheel shaft 16 is mounted to the other end of the swing arm 18, a hammer wheel 17 is mounted on the hammer wheel shaft 16, a grind ring 12 is mounted to an inner wall of the casing 2 corresponding to the hammer wheel 17, a reducing flow ring 19 is mounted below the grind ring 12; the material-sorting balance wheel device comprises a material-sorting balance wheel 14, the material-sorting balance wheel 14 and the hammer wheel 17 are on a same horizontal plane, the material-sorting balance wheel 14 is mounted to one end of a swing rod 13 by a material-sorting balance wheel shaft 34, the other end of the swing rod 13 is mounted on the stelliform bracket 9 by a swing rod shaft 38; a cross section of the arched material feeding bucket 11 is trapezoidal, the arched material feeding bucket 11 is mounted on an inner wall of a circular ring pressure plate 22, the circular ring pressure plate 22 is fixed to the upper end of the casing 2; at least two layers of hammer wheel grinding devices and material-sorting balance wheel devices are mounted on the stelliform bracket 9; a material scraping plate 21 is mounted to a lower end of the hammer wheel shaft 16; the swing arm shaft 15 is mounted on the stelliform bracket 9 by a swing arm bearing 32, two bearing dustproof caps 31 are respectively mounted at an upper side and a lower side of the swing arm bearing 32, the swing arm 18 is mounted on the swing arm shaft 15 by a locking screw 33; a hammer wheel seat 26 is mounted on the hammer wheel shaft 16, the hammer wheel seat 26 is mounted on the hammer wheel shaft 16 by a hammer wheel seat locking screw 29, a hammer wheel bearing 27 is mounted between the hammer wheel shaft 16 and the hammer wheel seat 26, two hammer wheel bearing dustproof caps 25 are respectively mounted at an upper end and a lower end of the hammer wheel bearing 27, a ring gasket 28 is mounted on the hammer wheel shaft 16 between the hammer wheel bearing 27 and the swing arm 18, the hammer wheel 17 is mounted on the hammer wheel seat 26 by a hammer wheel pressure ring 24; a material-sorting balance wheel seat 35 is mounted on the material-sorting balance wheel shaft 34, a balance wheel seat bearing 36 is mounted between the material-sorting balance wheel shaft 34 and the material-sorting balance wheel seat 35, two balance wheel seat bearing dustproof caps 37 are respectively mounted at an upper end and a lower end of the material-sorting balance wheel seat 35, the material-sorting balance wheel 14 is mounted on the material-sorting balance wheel seat 35; a material-sorting balance wheel shaft sliding sleeve 40 is mounted between the two balance wheel seat bearing dustproof caps 37 and the material-sorting balance wheel shaft 34, a sealing ring 41 is mounted between a contacting surface of the material-sorting balance wheel shaft sliding sleeve 40 and a contacting surface of the material-sorting balance wheel shaft 34, a sliding sleeve 39 is mounted between a contacting surface of the swing rod 13 and a contacting surface of the swing rod shaft 38; the material-sorting balance wheel 14 is made of rubber; a plurality of material screening holes 42 are provided on a horizontal ring surface of the reducing flow ring 19.

The working principle of the present invention is as follows.

While starting, the main shaft 3 drives three sets of hammer wheel grinding devices to operate, the hammer wheel 17 gradually closes to the inner wall of the grind ring 12, produces a linear pressure to the inner wall of the grind ring 12 under the effect of the inertial centrifugal force and rotates relying on the friction; while materials falling, the hammer wheel 17 grinds the materials, an inertial centrifugal force is simultaneously produced at the other end of the swing arm 18, the swing arm shaft 15 of the swing arm 18 is taken as a fulcrum, based on the principle of planar force system, a balancing moment is produced on the fulcrum, a ground pressure of the hammer wheel 17 can be adjusted by adjusting a corresponding position of the balance hammer 23 or changing a weight thereof According to material grinding levels, the ground pressure of every layer can be set, the ground pressure of the grinding layer without meeting the level requirements is correspondingly adjusted to achieve the best effect.

The rubber material-sorting balance wheel 14 of the material-sorting balance wheel device and the hammer wheel 17 are evenly dislocated and distributed at the same rotary plane. While operating the main shaft 3, the three sets of material-sorting balance wheel devices are driven, the rubber material-sorting balance wheel 14 runs along the inner wall of the grind ring 12 under the effect of the inertial centrifugal force and flexibly contacts with the inner wall of the grind ring 12. Under the loop wall friction, the rubber material-sorting balance wheel 14 also can revolve on its own axis. While materials falling, the rubber material-sorting balance wheel 14 presses the materials to the inner wall of the grind ring 12. After the rubber material-sorting balance wheel 14 leaves, the materials are transiently stagnated and ground by the subsequent hammer wheel 17. If the material bed of the falling materials is uneven, the rubber material-sorting balance wheel 14 is capable of flexibly crushing the materials on the loop wall to the vacancy of the inner wall of the grind ring 12 for stabilizing the material bed so as to allow the hammer wheel 17 to continuously evenly grind the materials.

The material scraping plate 21 is capable of being mounted to the lower portion of every hammer wheel shaft 16, and the shape of the material scraping plate 21 can be a straight line or a curve. While the hammer wheel 17 grinding the materials, the radial micro swing is produced to drive the material scraping plate 21 to vibrate for scraping the materials accumulated on the inner wall of the casing 2.

What is claimed is:

1. A flexible vertical grinder, wherein a casing (2) is fixed on a grinder frame (1), a main shaft mounting frame (4) is located on the grinder frame (1), a main shaft (3) is mounted on the main shaft mounting frame (4), a large pulley (5) is mounted to a lower end of the main shaft (3), a spoke (6) of the large pulley (5) is downwardly spiral; a material unloading bucket (8) is mounted to a lower end of the casing (2) within the grinder frame (1), a material receiving bucket (7) is located at an upper side face of an outer edge of an inner ring of the large pulley (5), the material receiving bucket (7) is sleevedly mounted on an outer side face of a lower end of the material unloading bucket (8); an arched material feeding bucket (11) is mounted on an upper end of the casing (2); a stelliform bracket (9) is mounted on the main shaft (3) within the casing (2), an upper end of the stelliform bracket (9) is fixed on the main shaft (3) by a pressure plate (10), a hammer wheel grinding device and a material-sorting balance wheel device are mounted on the stelliform bracket (9); the hammer wheel grinding device comprises a swing arm (18), the swing arm (18) is mounted on the stelliform bracket (9) by a swing arm shaft (15), a balance hammer (23) is mounted to one end of the swing arm (18), a hammer wheel shaft (16) is mounted to the other end of the swing arm (18), a hammer wheel (17) is mounted on the hammer wheel shaft (16), a grind ring (12) is mounted to an inner wall of the casing (2) corresponding to the hammer wheel (17), a reducing flow ring (19) is mounted below the grind ring (12); the material-sorting balance wheel device comprises a material-sorting balance wheel (14), the material-sorting balance wheel (14) and the hammer wheel (17) are on a same horizontal plane, the material-sorting balance wheel (14) is mounted to one end of a swing rod (13) by a material-sorting balance wheel shaft (34), the other end of the swing rod (13) is mounted on the stelliform bracket (9) by a swing rod shaft (38).

2. The flexible vertical grinder, as recited in claim 1, wherein a cross section of the arched material feeding bucket (11) is trapezoidal, the arched material feeding bucket (11) is mounted on an inner wall of a circular ring pressure plate (22), the circular ring pressure plate (22) is fixed to the upper end of the casing (2).

3. The flexible vertical grinder, as recited in claim 1, wherein at least two layers of hammer wheel grinding devices and material-sorting balance wheel devices are mounted on the stelliform bracket (9).

4. The flexible vertical grinder, as recited in claim 1, wherein a material scraping plate (21) is mounted to a lower end of the hammer wheel shaft (16).

5. The flexible vertical grinder, as recited in claim 1, wherein the swing arm shaft (15) is mounted on the stelliform bracket (9) by a swing arm bearing (32), two bearing dustproof caps (31) are respectively mounted at an upper side and a lower side of the swing arm bearing (32), the swing arm (18) is mounted on the swing arm shaft (15) by a locking screw (33).

6. The flexible vertical grinder, as recited in claim 1, wherein a hammer wheel seat (26) is mounted on the hammer wheel shaft (16), the hammer wheel seat (26) is mounted on the hammer wheel shaft (16) by a hammer wheel seat locking screw (29), a hammer wheel bearing (27) is mounted between the hammer wheel shaft (16) and the hammer wheel seat (26), two hammer wheel bearing dustproof caps (25) are respectively mounted at an upper end and a lower end of the hammer wheel bearing (27), a ring gasket (28) is mounted on the hammer wheel shaft (16) between the hammer wheel bearing (27) and the swing arm (18), the hammer wheel (17) is mounted on the hammer wheel seat (26) by a hammer wheel pressure ring (24).

7. The flexible vertical grinder, as recited in claim 1, wherein a material-sorting balance wheel seat (35) is mounted on the material-sorting balance wheel shaft (34), a balance wheel seat bearing (36) is mounted between the material-sorting balance wheel shaft (34) and the material-sorting balance wheel seat (35), two balance wheel seat bearing dustproof caps (37) are respectively mounted at an upper end and a lower end of the material-sorting balance wheel seat (35), the material-sorting balance wheel (14) is mounted on the material-sorting balance wheel seat (35).

8. The flexible vertical grinder, as recited in claim 1, wherein a material-sorting balance wheel shaft sliding sleeve (40) is mounted between two balance wheel seat bearing dustproof caps (37) and the material-sorting balance wheel shaft (34), a sealing ring (41) is mounted between a contacting surface of the material-sorting balance wheel shaft sliding sleeve (40) and a contacting surface of the material-sorting balance wheel shaft (34), a sliding sleeve (39) is mounted between a contacting surface of the swing rod (13) and a contacting surface of the swing rod shaft (38).

9. The flexible vertical grinder, as recited in claim 1, wherein the material-sorting balance wheel (14) is made of rubber.

10. The flexible vertical grinder, as recited in claim 1, wherein a plurality of material screening holes (42) are provided on a horizontal ring surface of the reducing flow ring (19).

* * * * *